US006635165B1

(12) United States Patent
Wilbuer et al.

(10) Patent No.: US 6,635,165 B1
(45) Date of Patent: Oct. 21, 2003

(54) METHOD FOR COATING WORKPIECES

(75) Inventors: Klaus L. Wilbuer, Solingen (DE); Hans H. Urlberger, Ratingen (DE)

(73) Assignee: Enthone, Inc., West Haven, CT (US)

( * ) Notice: Subject to any disclaimer, the term of this patent is extended or adjusted under 35 U.S.C. 154(b) by 0 days.

(21) Appl. No.: 09/786,300

(22) PCT Filed: Aug. 28, 1999

(86) PCT No.: PCT/EP99/06358

§ 371 (c)(1),
(2), (4) Date: Jul. 13, 2001

(87) PCT Pub. No.: WO00/12782

PCT Pub. Date: Mar. 9, 2000

(30) Foreign Application Priority Data

Sep. 1, 1998 (EP) ..... 98116503

(51) Int. Cl.[7] ..... C25D 15/00

(52) U.S. Cl. ..... 205/109; 205/238; 205/245; 205/85; 205/255; 205/258; 148/426; 423/299

(58) Field of Search ..... 205/109, 238, 205/245, 255, 85, 258; 148/426; 423/299

(56) References Cited

U.S. PATENT DOCUMENTS 4,468,296 A * 8/1984 Abys et al. ..... 205/265
5,496,463 A * 3/1996 Mori et al. ..... 205/109
5,628,807 A 5/1997 Yoshitake et al.
5,651,872 A 7/1997 Takeuchi et al.

FOREIGN PATENT DOCUMENTS

EP 0 709 493 A2 5/1986
JP 1011998 1/1989

OTHER PUBLICATIONS

PCT International Search Report dated Sep. 1, 1998, of PCT/EP99/06358.

* cited by examiner

*Primary Examiner*—Roy King
*Assistant Examiner*—Wesley A. Nicolas
(74) *Attorney, Agent, or Firm*—Senniger, Powers, Leavitt & Roedel

(57) ABSTRACT

The invention relates to a method for coating workpieces. According to said method, an alloy containing at least phosphorus and nickel is precipitated from an electrolyte to produce a functional, especially corrosion-resistant and wear-resistant metallic coating. The aim of the invention is to provide a means of increasing wear resistance and hardness and improving the anti-corrosion effect with a significantly higher rate of incorporation of elementary phosphorus. To this end, an at least quarternary alloy with the components nickel, cobalt, wolfram and phosphorus is electrolytically precipitated in the form of a coating. The invention also relates to a corrosion-resistant and wear-resistant coating with essentially the following composition: 0.5 to 2.0 wt. % wolfram; 1.0 to 2.0 wt % cobalt; 15 to 20 wt. % phosphorus and at least 10 wt. % nickel.

11 Claims, 1 Drawing Sheet

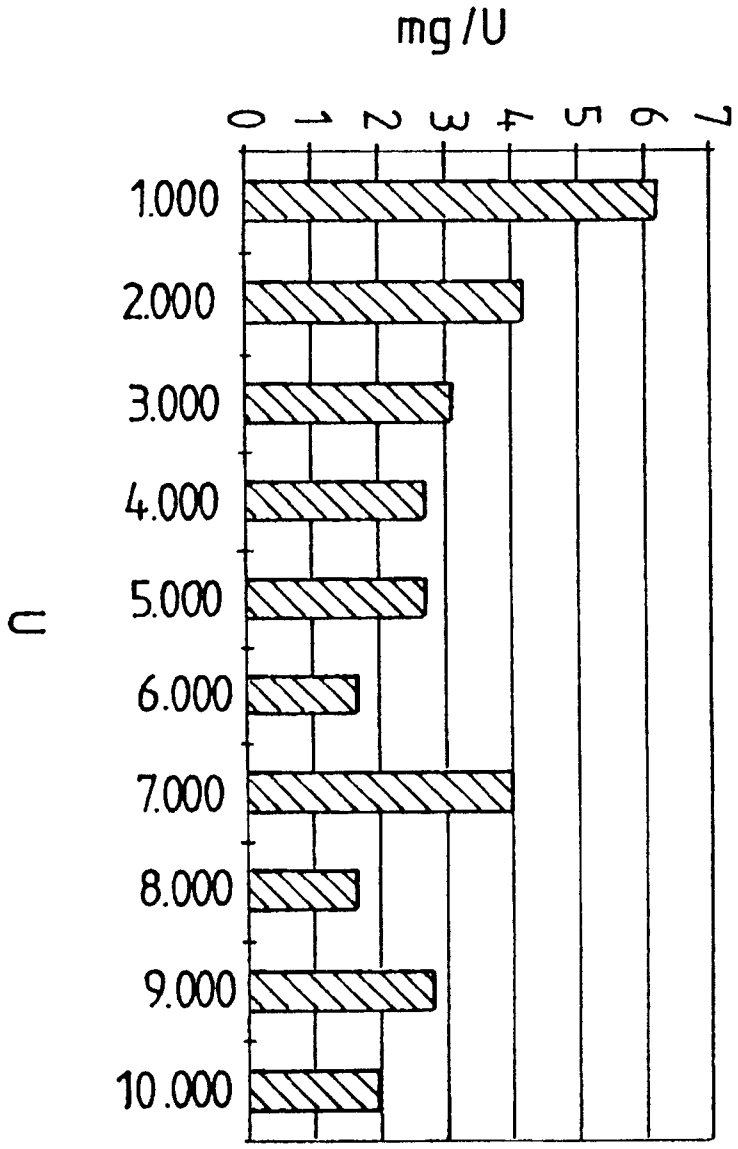
mg/U
7
6
5
4
3
2
1
0
1.000
2.000
3.000
4.000
5.000
6.000
7.000
8.000
9.000
10.000
U

METHOD FOR COATING WORKPIECES

The invention refers to a process far plating of work pieces, whereby for the formulation of a functional, especially corrosion-resistant and wear-resistant metallic coating, and at least phosphorus and nickle-containing alloy is precipitated from an electrolyte. The invention further refers to an appropriate coating.

Metallic coatings, in addition to their decorative uses, serve above all to create a functional coating of work pieces in order to deal with application-related load mechanisms by suitable surface properties such as, for example, hardness, wear resistance, frictional behavior or thermal and chemical resistance. The generation of such protective coatings is usually by galvanic precipitation. Here, a difference must be made between electrolytic precipitation on the one hand, where electro-crystallization takes place and, on the other hand, electro-chemical precipitation without external current which comprises a simple immersion system without external current source and anodes. The metal can be precipitated by these methods both onto metallic and also onto non-metallic work piece surfaces. Due to high contour definition during preciptation, the external current-less precipitation is used especially in the case of work pieces having a complex geometry requiring very tight tolerances. In this case electrolytic precipitation is severely limited due to the distribution of local cathode current densities related to the geometry.

In order to achieve a corrosion and wear-resistant metallic coating it therefore is known to precipitate higher phosphorous-containing polyalloys with nickel as the base metal without external current. Experiments have shown that the admixture of 0.5 to 1.5% by weight of cobalt to a nickel-cobalt-phosphorus coating with a phosphorus content of between 10 and 13% by weight can contribute to an increase in the internal pressure stress and the measurable hardness. It is further known that the phosphorus contents in the alloy matrix has a material influence on the passivation properties of a metallic coating. For example, corrosion tests have shown that the improved corrosion resistance can be achieved with a phosphorus contents of 14 to 21% by weight. However, it a disadvantage of the external current-less precipitation that due to the absence of express reaction mechanisms such high phosphorus contents can not be achieved.

It is the purpose of the invention to describe a process for coating work pieces which makes possible increased wear resistance and hardness, as well as an improved anti-corrosive effect, with a materially increased ratio of elemental phosphorus. In addition, a suitable coating will be described.

This purpose is achieved with a process of a type described at the outset in such a manner that an at least quaternary alloy with the components nickel cobalt, tungsten and phosphorus is precipitated electrolytically as a coating.

Such a process makes possible a ratio of phosphorus in the metallic coating of between 14 and 21% by weight due to the electrolytic precipitation and consequent forced reduced reaction systematic at the border between electrolyte and work piece. The invention is further based on the surprising finding that with the cathodic joint precipitation of nickel, cobalt, tungsten and phosphorus an alloy coating is formed which is marked by a high degree of corrosion and wear resistance.

It is of special advantage, depending on the functional application of the coating, to cathodically precipitate an alloy containing at least another component, preferably tin, lead, molybdenum, rhenium or vanadium. In this manner, for example, sufficient temperature resistance, the ability to be soldered, magnetic permeability or a suitable friction coefficient can be achieved in accordance with applicable requirements.

In accordance with a preferred extension of the invention, non-metallic particles, preferably carbide or mixed carbide crystals are embedded in the metallic matrix of the coating in order to additionally increase corrosion and wear resistance and hardness. Here it is of advantage to utilize carbides of boron, silicon, tungsten, vanadium and/or titanium. It is further of advantage if particles of a grain size of 0.1 to 1.5 $\mu$m are used.

Alternatively ultrafine particles with diameters in the nanometer range or particles with a grain size in excess of 1.5 $\mu$m may be used, depending on the desired border layer properties. In accordance with a further characteristic of the invention particles are deposited in different concentration within the range of the thickness of the coating. In this manner it is possible, for example, to achieve a higher concentration of deposited particles in the area of the coating facing the base material and a lesser concentration in the surface area of the coating. Therefore, the microporosity of the coating at the location of the particle deposit can be adjusted as required.

In accordance with the advantage of another extension of the invention the particles are added to the electrolyte as a dispersed phase and embedded into the alloy deposit with the galvanic precipitation. This addition, above all, can be traced to adsorption, electrostatic attraction and mechanical inclusion. For this purpose, the particles are held in suspension in the electrolyte by agitation of the galvanic bath. In the generally known manner particles are held in suspension, for example, by stirring or by blowing air into the bath. In order to be able to change the microporosity of the coating it is further useful to affect the concentration of the particles in the alloy precipitation by changing the bath agitation. In addition, the invention proposes that additionally color pigments preferably of titanium dioxide, are embedded which ensure a high degree of resistance to light and to climatic conditions.

To achieve the above purpose the invention proposes, in addition, a corrosion and wear-resistance coating which is achievable especially by the above-described process and which is characterized by a composition of generally 0.5 to 2.0% by weight tungsten 1.0 to 2.0% by weight cobalt 15 to 20% by weight phosphorus and at least 10% by weight nickel Finally, especially in order to further improve wear resistance, is proposed that 30 to 39% by volume of boron, carbide embedded in the metallic matrix of the coating.

Additional details, characteristics and advantages of the subjects of the invention are obvious from the following description of a preferred application example. The attached drawing shows only the abrasion resistance according to TABER for a nickel-phosphorus-cobalt-tungsten-boron carbide coating in a bar graph.

A metallic coating is formed by galvanic alloy precipitation which comprises 0.5 to 2.0% by weight of tungsten, 1.0 to 2.0% by weight cobalt, 15 to 20% by weight phosphorus and a remaining proportion of nickel. The metallic matrix of this alloy precipitation, additionally, shows embedded non-metallic particles of boron tetracarbide. These have been built into the coating during the electro-crystallization by mechanical inclusion, adsorption or electrostatic attraction in the vicinity of the cathode. For this reason the boron tetracarbide occurs in the electrolytes used for precipitation in the form of a suspended fine powder, whereby the particles show a grain size of 0.1 to 1.5 μm. These particles are held in suspension, evenly distributed in the electrolyte, by suitable bath movement, for example by mechanical stirring. Inclusion of the particles at different concentration over the range of the coating can be achieved by an appropriate change of the bath agitation. The coating produced in this manner shows over-all a proportion of 30 to 39% by volume of boron tetracarbide, Due to the interaction of the components nickel, cobalt tungsten, phosphorus and boron carbide the coating shows a high resistance both to acidic and to alkaline corrosive media as well as to oxidizing acids. The salt spray used for corrosion testing in accordance with DIN 50 021 for more rigorous conditions, with the addition of copper chloride, showed an exposure of more than 485 h at a coating thickness of 60 μm and a base material of steel. Thus, the coating meets the requirements of RAL-RG 660 for level 4/4 hydraulics in mine workings.

The coating also is notable for high wear resistance. At a mean surface roughness of approximately 2 to 3 μm the wear resistance according to TABER was determined by applying scraping wear test criteria. Here, type CS-10 friction rolls under an applied load of 9.81 N were used. In the precipitation state, the coating after 10,000 revolutions achieved an average wear value of 2.71 mg/1,000 revolutions as can be seen on the drawing especially in the progression of the wear removal values according to TABER in mg/1,000 revolutions over the revolutions U. The stabilization behavior of the friction rollers was not taken into consideration. The wear value lies below the wear resistance of max. 5 mg/1,000 rotations expected for hard chrome coatings in accordance with RAL-RG 660 (1986). By comparison, electrolytically precipitated conventional nickle phosphorus alloys achieve wear values of 11 to 13 mg/1,000 rotations, while external current-free precipitated coatings average a friction resistance of 20 to 12 mg/1,000 rotations.

By means of the process described above, and with the metallic coating achievable by its use, the progressively more restrictive requirements of chemical and mechanical resistance of coated work piece surfaces are catered for.

What is claimed is:

1. A process for the plating of work pieces, comprising precipitating from an electrolyte a corrosion and wear-resistant coating comprising at least a quaternary alloy with the components nickel, cobalt, about 0.5 to about 2.0 wt % tungsten, and phosphorus.

2. The process of claim 1 wherein the coating further comprises a metallic precipitate selected from among tin, lead, molybdenum, rhenium, and vanadium.

3. The process of claim 1 wherein the coating further comprises carbide or mixed carbide crystal particles.

4. The process of claim 1 wherein the coating comprises carbide particles selected from among carbides of boron, silicon, tungsten, vanadium, titanium, and mixtures thereof.

5. The process of claim 4 wherein the carbide particles have a grain size in the range of 0.1 μm to 1.5 μm.

6. The process of claim 3 wherein the particles are deposited in different concentrations within a range of thickness of the coating.

7. The process of claim 3 wherein the particles are present in the electrolyte in a dispersed phase and are imbedded into the coating by galvanic precipitation.

8. The process in accordance with claim 7, characterized by the particles being held in suspension in the electrolyte by agitating the galvanic bath.

9. The process in accordance with claim 8, characterized by the concentration of the alloy precipitation being influenced by changes in the bath agitation.

10. The process in accordance with claim 1, comprising embedding titanium dioxide pigments into the coating.

11. The process of claim 1 wherein the alloy comprises, generally:

0.5 to 2.0% by weight tungsten 1.0 to 2.0% by weight cobalt 15 to 20% by weight phosphorus at least 10% by weight nickel; and carbide particles selected from among carbides of boron, silicon, tungsten, vanadium, titanium, and mixtures thereof.

* * * * *